US006975311B2

(12) United States Patent
Ide et al.

(10) Patent No.: US 6,975,311 B2
(45) Date of Patent: Dec. 13, 2005

(54) APPARATUS FOR DRIVING DISPLAY PANEL

(75) Inventors: Shigeo Ide, Yamanashi-ken (JP); Takashi Iwami, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 86 days.

(21) Appl. No.: 10/791,758

(22) Filed: Mar. 4, 2004

(65) Prior Publication Data

US 2004/0174356 A1 Sep. 9, 2004

(30) Foreign Application Priority Data

Mar. 6, 2003 (JP) ..... 2003-059613

(51) Int. Cl.[7] ..... G09G 3/36; G09G 5/00

(52) U.S. Cl. ..... 345/209; 345/100; 345/204; 345/205; 345/206; 345/211; 345/212

(58) Field of Search ..... 345/90–100, 204–206, 345/208–214

(56) References Cited

U.S. PATENT DOCUMENTS 5,633,659 A * 5/1997 Furuhashi et al. ..... 345/173
6,329,980 B1 * 12/2001 Uehara et al. ..... 345/204
2003/0095117 A1 * 5/2003 Katagawa et al. ..... 345/208

FOREIGN PATENT DOCUMENTS

JP 11-73156 A 3/1999

* cited by examiner

*Primary Examiner*—Vijay Shankar
(74) *Attorney, Agent, or Firm*—Sughrue Mion, PLLC

(57) ABSTRACT

A drive apparatus for applying first and second drive pulses to row electrodes to drive a display panel having the row electrodes, column electrodes arranged to intersect the row electrodes, and capacitive light-emitting elements each disposed at each point of intersection of the row electrodes and the column electrodes. The drive apparatus includes a clamping circuit and a masking circuit which are formed in a module.

4 Claims, 9 Drawing Sheets

FIG. 7

| Ds | HD 1 | 2 | 3 | 4 | 5 | 6 | 7 | 8 | 9 | 10 | 11 | 12 | 13 | 14 | ONE FIELD EMISSION DRIVE PATTERN SF 1 | SF 2 | SF 3 | SF 4 | SF 5 | SF 6 | SF 7 | SF 8 | SF 9 | SF 10 | SF 11 | SF 12 | SF 13 | SF 14 | EMISSION INTENSITY |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLE : SELECTIVE ERASE DISCHARGE
HOLLOW CIRCLE : EMISSION

APPARATUS FOR DRIVING DISPLAY PANEL

BACKGROUND OF THE INVENTION

1. Field of the Invention

The present invention relates to an apparatus for driving a display panel such as a plasma display panel.

2. Description of the Related Background Art

An apparatus disclosed in Japanese Patent Laid-Open Publication No. Hei 11-73156 is known as one of conventional apparatuses for driving a plasma display panel. The conventional drive apparatus is designed to drive an AC (alternating-current discharge) plasma display panel (hereinafter referred to as the PDP). The PDP includes row electrode pairs having row electrodes X1 to Xn and row electrodes Y1 to Yn (n is the number of rows), and column electrodes D1 to Dm (m is the number of columns) which are disposed in orthogonal relation to the row electrode pairs with a dielectric layer and a discharge gap sandwiched therebetween. The row electrode pairs and the column electrodes define portions of intersection, at each of which a discharge cell is formed. The discharge cells serve as the m by n pixels of the PDP screen.

The PDP drive apparatus converts an input video signal to N bits of pixel data for each one pixel, and then converts the pixel data to m pixel data pulses for each one row in the PDP to apply the pixel data pulses to the respective column electrodes D1 to Dm of the PDP. Additionally, at predetermined time points, the PDP drive apparatus generates row electrode drive signals which each include a reset pulse RPx, a reset pulse RPy, a scan pulse SP, a sustain pulse IPx, a sustain pulse IPy, and an erase pulse EP, which are applied to the row electrode pairs (X1 to Xn, Y1 to Yn) of the PDP. Application of the reset pulses RPx and RPy, which are generated in a reset step, causes all the discharge cells of the PDP to be excited by discharge to generate charged particles. After the discharge has been terminated, a predetermined amount of wall charges is formed in the dielectric layer of all the discharge cells. The scan pulse SP, which is generated in a pixel data write step, is supplied to a row electrode, a discharge cell on which is supplied with a pixel data pulse. This determines whether a discharge is sustained at the discharge cell. The wall charges of a discharge cell whose discharge is sustained in response to the pixel data pulse are sustained to remain unchanged, whereas the wall charges of a discharge cell whose discharge is not sustained are erased. The sustain pulses IPx, IPy, which are generated in a sustain discharge step, are applied to the row electrode, thereby creating a discharge in the discharge cell whose the discharge is sustained. The erase pulse EP, which is generated in an erase step, is applied to all the row electrodes, thereby erasing the wall charges of all the discharge cell.

FIG. 1 shows a pulse circuit for generating the reset pulse RPy and the sustain pulse IPy, discussed above, for the row electrodes Y1 to Yn in the drive apparatus that is disclosed in Japanese Patent Laid-Open Publication No. Hei 11-73156. The pulse circuit includes a sustain pulse generator 120, a reset pulse generator 130, and a P-channel MOS (Metal Oxide Semiconductor) transistor Q7 serving as a switch element.

As shown in FIG. 2, the reset pulse generator 130 has a MOS transistor Q5 turned on during the reset step in response to an externally supplied gate signal GT5 of logic level "1". This causes a negative potential at the negative terminal of a DC power supply B2 to be applied to a line 300 via the transistor Q5 and a resistor R1, allowing the reset pulse RPy of a negative voltage to be applied to the row electrodes Y1 to Yn of the PDP. The resistor R1 acts to slant the front edge portion in the waveform of the reset pulse RPy. On the other hand, the MOS transistor Q7, supplied with a gate signal GT7 of logic level "1", is in the OFF state. Accordingly, at least during the reset pulse RPy being generated, there exists a non-conducting state between a line 200 and the line 300.

In the sustain pulse generator 120, the logic level of a gate signal GT3 is switched sequentially from "0" through "1" to "0", the logic level of the gate signal GT3 from "1" through "0" to "1", and the logic level of a gate signal GT2 from "0" through "1" to "0" during the sustain discharge step as shown in FIG. 2, thereby allowing the sustain pulse IPy of a positive voltage to be generated. That is, first, a MOS transistor Q3 is turned on in response to the gate signal GT3 of logic level "1", causing a current corresponding to the amount of charges stored in a capacitor C1 to flow into the line 200 via the MOS transistor Q3, a diode D2, and a coil L2. At this time, the MOS transistor Q7 having the gate signal GT7 of logic level "0" supplied thereto is in the ON state, thereby connecting between the lines 200 and 300. This allows the level of the line 300 or the row electrodes Y1 to Yn of the PDP to gradually increase. This is the leading edge portion of the sustain pulse IPy. Then, a MOS transistor Q1 is turned on in response to a gate signal GT1 of logic level "1". This causes a positive potential at the positive terminal of a DC power supply B1 to be applied to the line 200 and the line 300 via the MOS transistor Q7, thereby providing the sustain pulse IPy of a predetermined positive voltage. Then, a MOS transistor Q2 is turned on in response to the gate signal GT2 of logic level "1". This causes a current corresponding to the amount of charges carried by the PDP to flow into the capacitor C1 via the MOS transistor Q2, a diode D1, and a coil L1. The capacitor C1 is recharged as such to gradually decrease the level of the row electrodes Y1 to Yn of the PDP, causing the sustain pulse IPy to vanish.

In a discharge cell having wall charges, application of the sustain pulse thereto during the sustain discharge step causes a sustain discharge, allowing a discharge current to flow from the power supply B1 to the row electrode via the transistor Q1 and the transistor Q7, as described above.

When the discharge current flows and then stops flowing instantaneously, the inductance component of the wiring in the current path from the MOS transistor Q1 to the row electrode including the lines 200 and 300 causes a counter electromotive force to be generated, the voltage to be oscillated, and ripples to occur in the drive pulse waveform. This raised a problem of deterioration in brightness and emission efficiency.

SUMMARY OF THE INVENTION

It is therefore an object of the present invention to provide a display panel drive apparatus which improves the waveform of drive pulses to provide improved brightness and emission efficiency.

The present invention provides a drive apparatus for applying a first drive pulse and a second drive pulse to row electrodes to drive a display panel having the row electrodes, column electrodes arranged to intersect the row electrodes, and capacitive light-emitting elements disposed at intersection portions of the row electrodes and the column electrodes, the apparatus comprising: a first drive pulse generation portion having a resonance circuit for selectively forming a forward/reverse current path including inductance, and a clamping circuit that includes a first switch for selectively clamping an output terminal potential of the resonance circuit at a power supply potential and a second switch for selectively clamping the output terminal potential of the resonance circuit at a ground potential, for generating the first drive pulse to be applied to an output line; a second drive pulse generation portion for generating the second drive pulse to be applied to the row electrodes; and a masking circuit which is turned on to connect between the output line and the row electrodes when the first drive pulse generation portion applies the first drive pulse to the row electrodes, and which is turned off to disconnect between the output line and the row electrodes when the second drive pulse generation portion applies the second drive pulse to the row electrodes, wherein the clamping circuit and the masking circuit are formed in a module.

BRIEF DESCRIPTION OF THE DRAWINGS

FIG. 7 is a view illustrating an emission drive pattern in one field;

DETAILED DESCRIPTION OF THE INVENTION

An embodiment of the present invention will be explained below in more detail with reference to the accompanying drawings.

Figure 1:
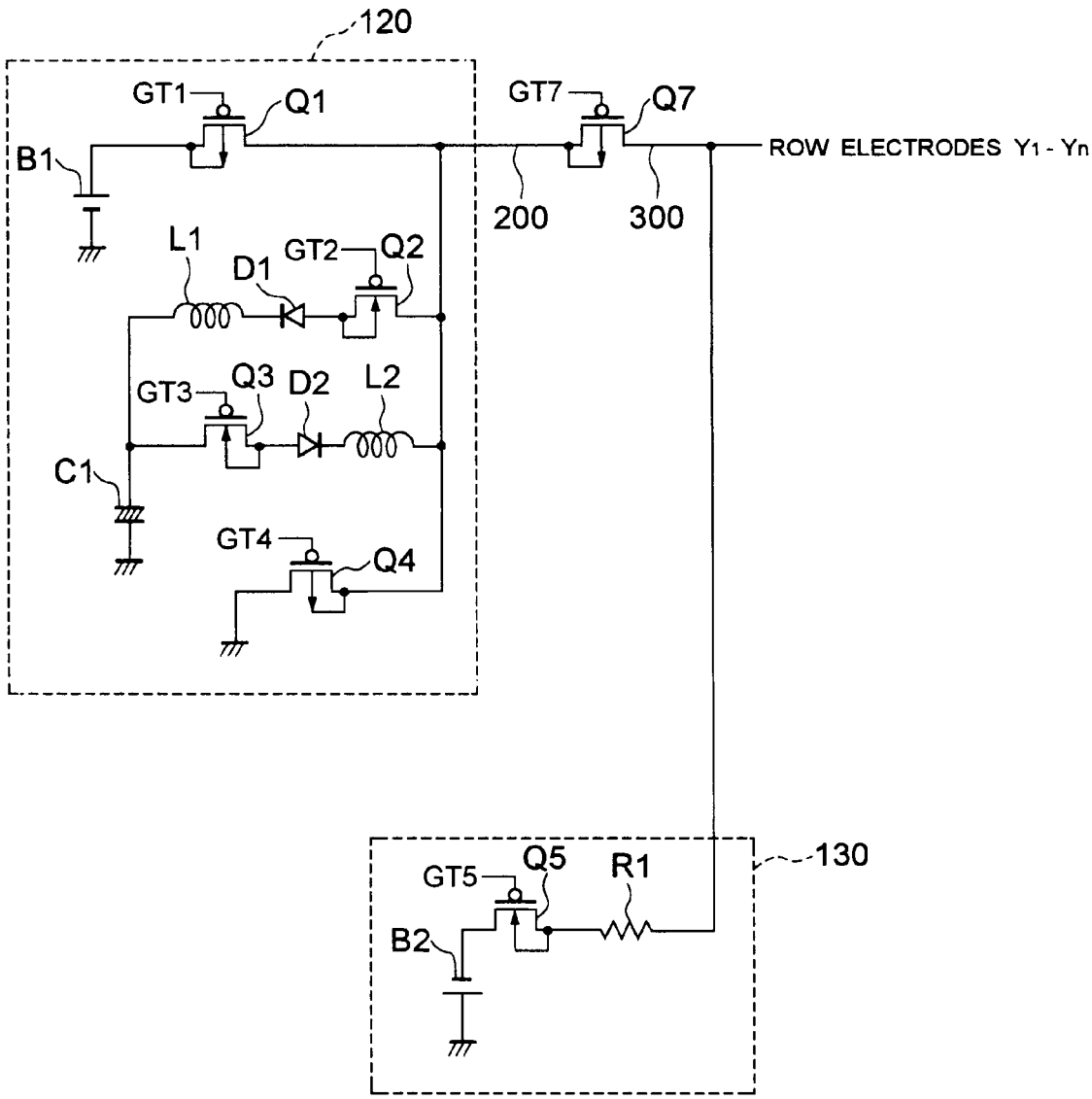
FIG. 1 is a circuit diagram illustrating conventional reset pulse and sustain pulse generators.
Figure 2:
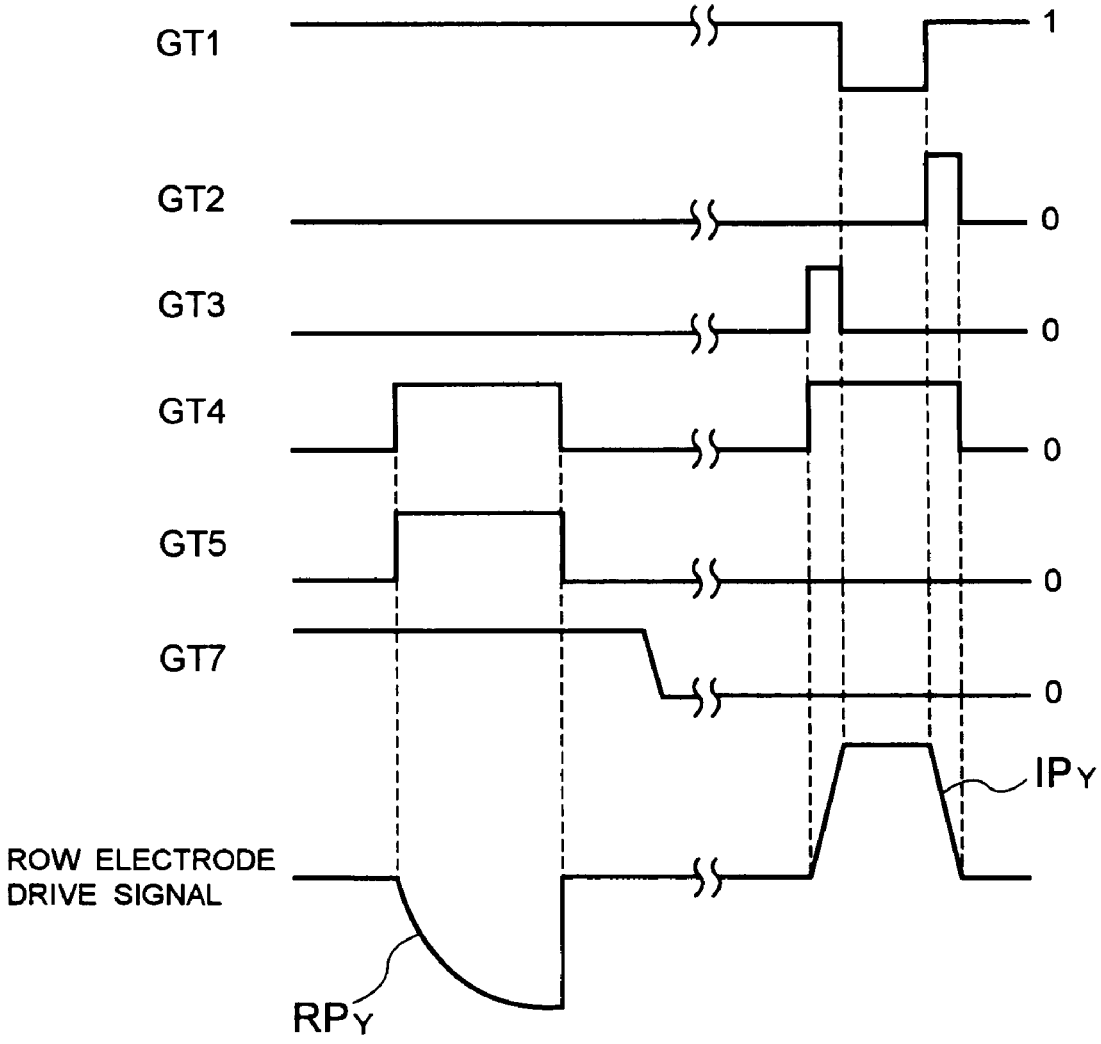
FIG. 2 is a view illustrating signal waveforms at portions in the circuit of FIG. 1.
Figure 3:
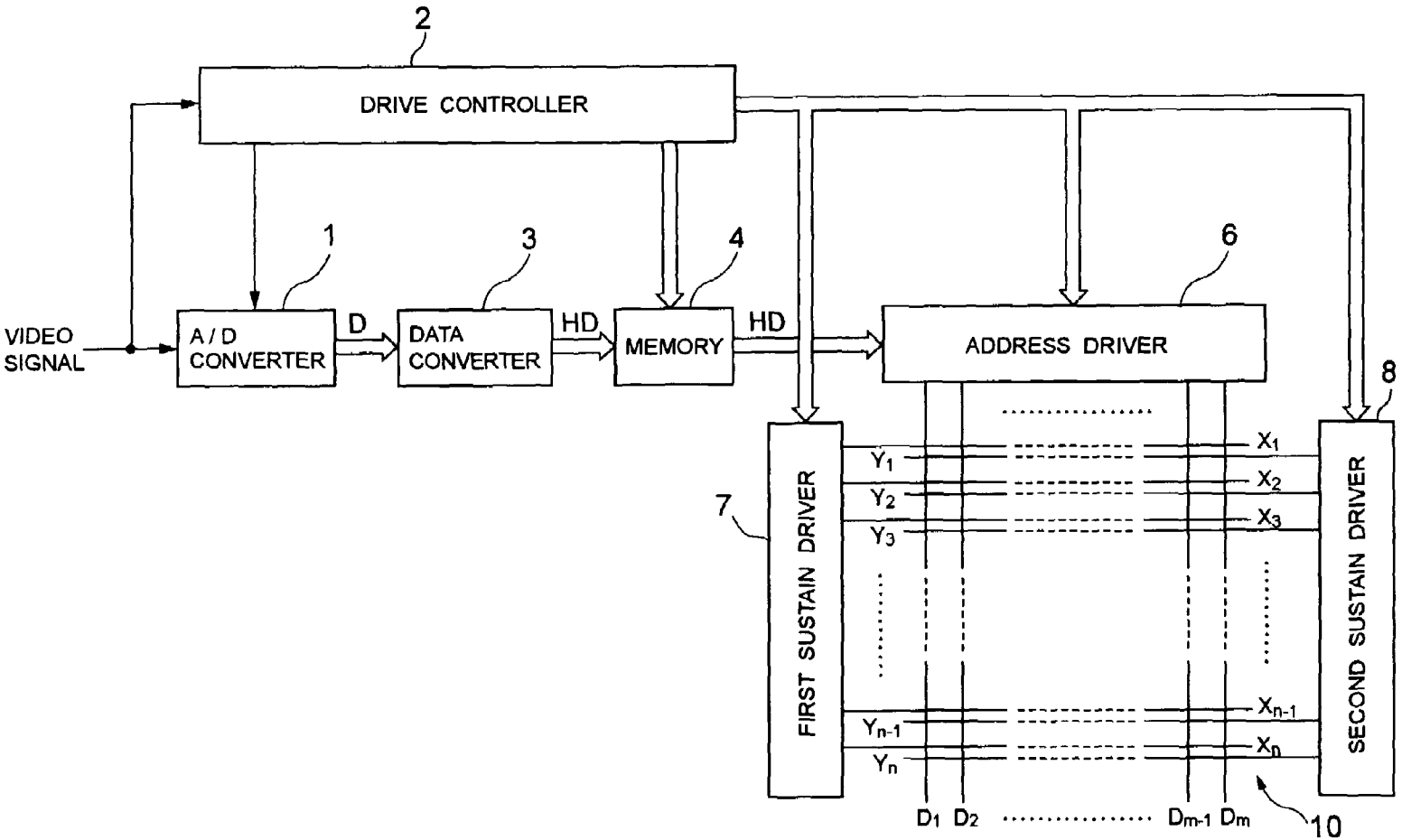
FIG. 3 is a block diagram illustrating the configuration of a PDP apparatus employing the present invention.

FIG. 3 shows the configuration of a plasma display panel (PDP) apparatus to which the present invention is applied. The PDP apparatus shown in FIG. 3 includes an A/D converter 1, a drive controller 2, a data converter 3, a memory 4, an address driver 6, a first sustain driver 7, a second sustain driver 8, and a PDP 10.

The A/D converter 1 samples an analog input video signal in response to a clock signal supplied by the drive controller 2 to convert the sampled video signal into pixel data D of 8 bits, for example, for each one pixel, supplying the pixel data D to the data converter 3.

In sync with the horizontal and vertical synchronous signals in the input video signal, the drive controller 2 generates the aforementioned clock signal for the A/D converter 1 and a read/write signal for the memory 4. Additionally, in accordance with the emission drive format shown in FIG. 4, the drive controller 2 generates various switching signals for the gray scale drive of the PDP 10 to supply the switching signals each to the address driver 6, the first sustain driver 7, and the second sustain driver 8.

The data converter 3 converts the 8-bit pixel data D to 14-bit converted pixel data (display pixel data) HD to supply the resulting converted pixel data HD to the memory 4.

The memory 4 sequentially writes the aforementioned converted pixel data HD in response to a write signal supplied by the drive controller 2. When this write operation finishes writing a screenful of data (for m columns by n rows), the memory 4 reads the screenful of converted pixel data $HD_{1,1}$ to $HD_{m,n}$ in the form of bit digits to supply the resulting converted pixel data to the address driver 6 for each one display line.

In response to a timing signal supplied by the drive controller 2, the address driver 6 generates m pixel data pulses each having a voltage corresponding to the logic level of each bit of the converted pixel data for one display line which has been read out of the memory 4, and then supplies these pixel data pulses to the corresponding column electrodes D1 to Dm of the PDP 10.

The first and second sustain drivers 7, 8 generate various drive pulses in response to the timing signal supplied by the drive controller 2 to apply the resulting pulses to the row electrodes X1 to Xn and Y1 to Yn of the PDP 10.

The PDP 10 includes m column electrodes D1 to Dm, and the row electrodes X1 to Xn and Y1 to Yn, which are arranged to intersect the column electrodes. In the PDP 10, each of the row electrode pairs (X1, Y1), (X2, Y2), . . . , (Xn, Yn) corresponds to one display line. For example, the row electrode pair in the first row (the first display line) of the PDP 10 is (X1, Y1), while the row electrode pair in the nth row (the nth display line) of the PDP 10 is (Xn, Yn). The column electrodes D1 to Dm and the row electrode pairs (X1, Y1) to (Xn, Yn) are each coated with a dielectric layer, the column electrodes D1 to Dm being disposed to oppose the row electrode pairs (X1, Y1) to (Xn, Yn) via the discharge gap at their points of intersection. Each discharge gap has a discharge gas such as xenon (Xe) sealed therein, while the row electrode pairs (X1, Y1) to (Xn, Yn) and the column electrodes D1 to Dm define a discharge cell, serving as a display pixel, at each point of intersection. As such, the discharge cells are arranged in a matrix.

Figure 5:
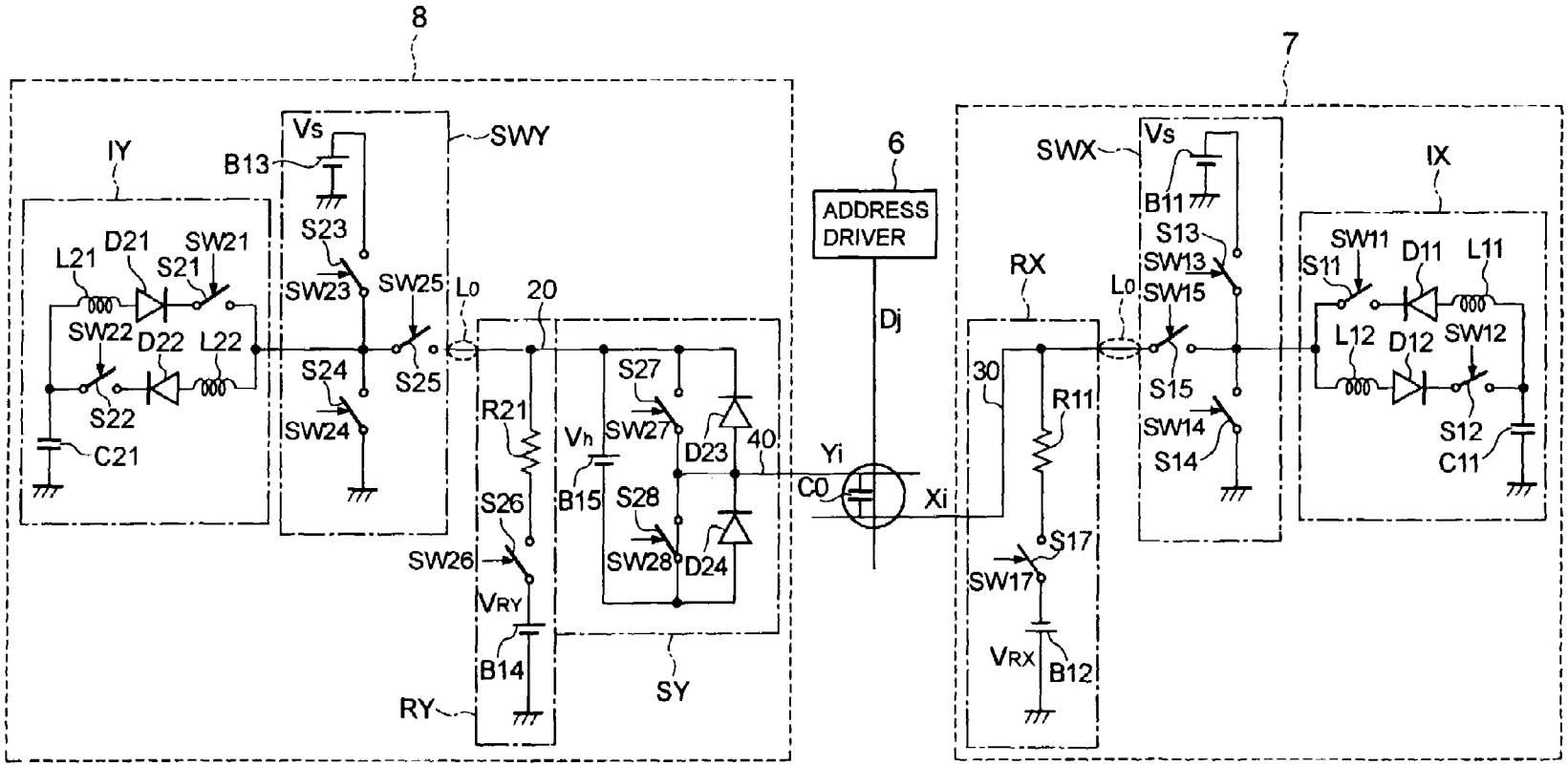
FIG. 5 is a circuit diagram illustrating the internal configuration of a first and a second sustain driver.

FIG. 5 shows the internal configuration of the first and second sustain drivers 7, 8. That is, FIG. 5 details the configuration of the first and second sustain drivers 7, 8 and the discharge cell defined by a row electrode pair (Xi, Yi) and a column electrode Dj, where $1 \leqq i \leqq n$ and $1 \leqq j \leqq m$. The capacitance between the electrodes Xj and Yj serves as load capacitance C0.

As shown in FIG. 5, the first sustain driver 7 includes a reset pulse generator RX for generating the reset pulse RPx, a switch module SWX having three switch elements, and a sustain pulse generator IX for generating the sustain pulse IPx.

The sustain pulse generator IX, which is a resonance circuit, includes a capacitor C11, switch elements S11, S12, coils (inductors) L11, L12, and diodes D11, D12. The switch element S11, the diode D11, and the coil L11 are connected in series in that order, with the polarity being determined such that the anode of the diode D11 is located on the coil L11 side. The coil L12, the diode D12, and the switch element S12 are connected in series in that order, with the anode of the diode D12 being located on the coil L12 side. Additionally, these two series circuits are connected in parallel. That is, one end of the switch element S11 is connected to one end of the coil L12, with one end of the coil L11 being connected to one end of the switch element S12. The line connecting between the coil L11 and the switch element S12 is connected to the ground via the capacitor C11. The line connecting between the switch element S11 and the coil L12, which serves as the input/output of the sustain pulse generator IX, is connected to the switch module SWX.

The switch module SWX includes three switch elements S13 to S15, which are provided on a circuit board separated from the one of the first sustain driver 7. The switch elements S13 to S15 are coupled at their respective one end to a common connection, which serves as one terminal for connecting the switch module SWX to an external circuit. The common connection line is connected to the input/output terminal of the sustain pulse generator IX. The other end of each of the switch elements S13 to S15 also serves as a terminal for connecting the switch module SWX to an external circuit. The other end of the switch element S13 is connected to the positive output terminal of a DC power supply B11. The DC power supply B11 outputs a DC voltage Vs. The negative output terminal of the DC power supply B11 is connected to the ground. The other end of the switch element S14 is also connected to the ground. The other end of the switch element S15, serving as the terminal for connection to an external circuit, is connected to the row electrode pair Xi via the reset pulse generator RX.

The switch elements S13 to S14 and the DC power supply B11 constitute a clamping circuit, while the switch element S15 constitutes a masking circuit.

The reset pulse generator RX includes a resistor R11, a switch element S17, and a DC power supply B12. The resistor R11, the switch element S17, and the DC power supply B12 are connected in series in that order. That is, these components are connected in series in between a connection line 30 to the row electrode pair Xi and the ground. The DC power supply B12 outputs a DC voltage $V_{RX}$. The DC power supply B12 has the negative output terminal connected to the switch element S17, and the positive output terminal connected to the ground.

The second sustain driver 8 includes a reset pulse generator RY for generating the reset pulse RPy, a scan pulse generator SY for generating the scan pulse SP, a switch module SWY having three switch elements, and a sustain pulse generator IY for generating the sustain pulse IPy.

The sustain pulse generator IY, which is a resonance circuit, includes a capacitor C21, switch elements S21, S22, coils (inductors) L21, L22, and diodes D21, D22. The switch element S21, the diode D21, and the coil L21 are connected in series in that order, with the polarity being determined such that the anode of the diode D21 is located on the coil L21 side. The coil L22, the diode D22, and the switch element S22 are connected in series in that order, with the polarity being determined such that the anode of the diode D22 is located on the coil L22 side. Additionally, these two series circuits are connected in parallel. That is, one end of the switch element S21 is connected to one end of the coil L22, with one end of the coil L21 being connected to one end of the switch element S22. The line connecting between the coil L21 and the switch element S22 is connected to the ground via the capacitor C21. The line connecting between the switch element S21 and the coil L22, which serves as the input/output of the sustain pulse generator IY, is connected to the switch module SWY.

The switch module SWY includes three switch elements S23 to S25, which are provided on a circuit board separate from the one of the second sustain driver 8. The switch elements S23 to S25 are coupled at their respective one end to a common connection, which serves as one terminal for connecting the switch module SWY to an external circuit. The common connection line is connected to the input/output terminal of the sustain pulse generator IY. The other end of each of the switch elements S23 to S25 also serves as a terminal for connecting the switch module SWY to an external circuit. The other end of the switch element S23 is connected to the positive output terminal of a DC power supply B13. The DC power supply B13 outputs the DC voltage Vs. The negative output terminal of the DC power supply B13 is connected to the ground. The other end of the switch element S24 is also connected to the ground. The other end of the switch element S25, serving as the terminal for the external connection, is connected to the scan pulse generator SY via the reset pulse generator RY.

The switch elements S23 to S24 and the DC power supply B13 constitute a clamping circuit, while the switch element S25 constitutes a masking circuit.

The reset pulse generator RY includes a resistor R21, a switch element S26, and a DC power supply B14. The resistor R21, the switch element S26, and the DC power supply B14 are connected in series in that order. That is, these components are connected in series in between a connection line 20 to the scan pulse generator SY and the ground. The DC power supply B14 outputs a DC voltage $V_{RY}$. The DC power supply B14 has the positive output terminal connected to the switch element S26, and the negative output terminal connected to the ground.

The scan pulse generator SY includes switch elements S27, S28, diodes D23, D24, and a DC power supply B15. One end of the switch element S27 is connected to the connection line 20 and the positive output terminal of the DC power supply B15, while the other end is connected to the switch element S28 and a connection line 40 to the row electrode pair Yi. Additionally, the switch element S27 is connected in parallel to the diode D23, while switch element S28 is connected in parallel to the diode D24. The anode of the diode D23 and the cathode of the diode D24 are connected to the connection line 40. The power supply B15 outputs a DC voltage Vh, with its positive output terminal connected to the connection line 20 as mentioned above and the negative output terminal connected to the connection line between the switch element S28 and the anode of the diode D24.

As shown in FIG. 5, each of the connection lines 20, 30 carries pattern impedance L0.

The switching signal delivered by the drive controller 2 provides ON or OFF control to the aforementioned switch elements S11 to S15, S17, and S21 to S28. The arrow at each switch element shown in FIG. 5 indicates a control signal terminal for receiving the switching signal from the drive controller 2.

It is now explained how to drive the PDP 10 using the first and second sustain drivers 7, 8.

Figure 4:
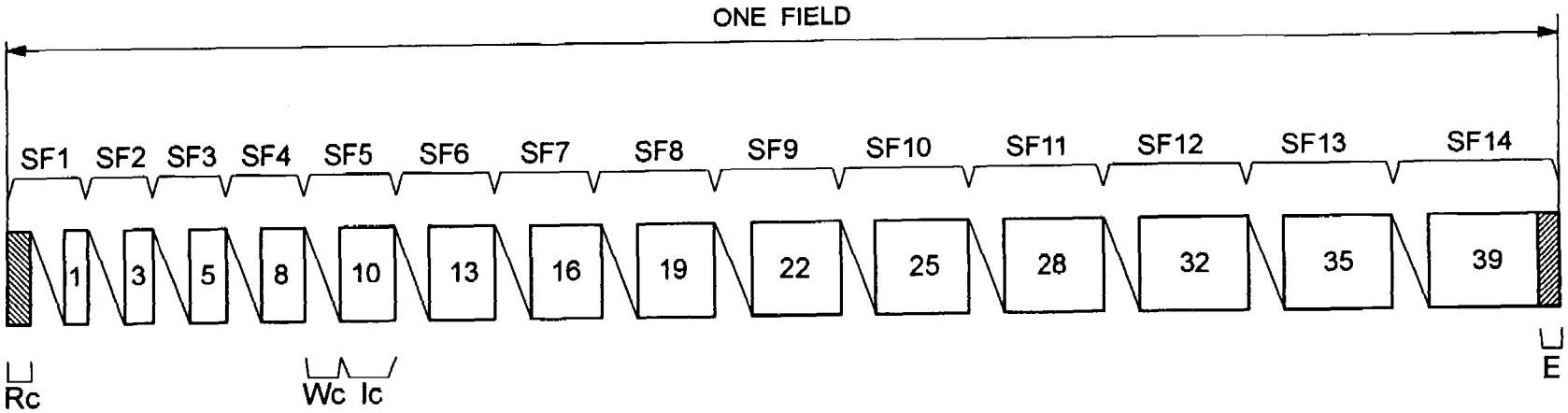
FIG. 4 is an explanatory view illustrating a division of one field into a plurality of sub-fields.
Figure 6:
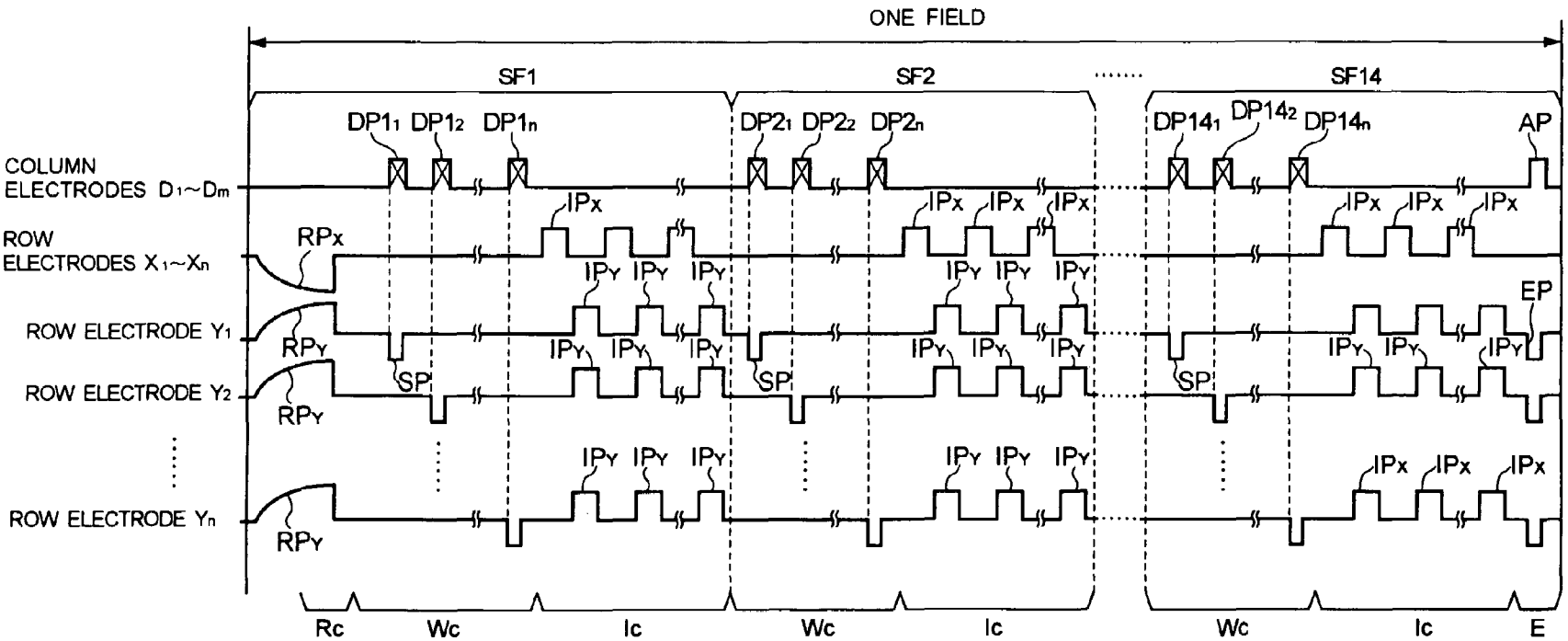
FIG. 6 is a view illustrating the generation timing of each drive pulse.

FIG. 6 illustrates the application timing of the various drive pulses to be applied in accordance with the emission drive format of FIG. 4 from each of the address driver 6, the first sustain driver 7, and the second sustain driver 8 to the column electrodes D1 to Dm and the row electrodes X1 to Xn and Y1 to Yn of the PDP 10.

In the example shown in FIG. 6, the display period of one field is divided into 14 sub-fields SF1 to SF14 as shown in FIG. 4 to drive the PDP 10. In each sub-field, performed are a pixel data write step Wc of writing pixel data to each discharge cell of the PDP 10 to set for emission or non-emission and an emission sustain step Ic of sustaining the emission from only the discharge cell that is set in an emission mode. Furthermore, a simultaneous reset step Rc of initializing all the discharge cells of the PDP 10 is performed only in the first sub-field SF1, while an erase step E is performed only in the last sub-field SF14 of the one field.

As shown in FIG. 6, in the simultaneous reset step Rc, the first and second sustain drivers 7, 8 apply simultaneously the reset pulses RPx, RPy to the row electrodes X1 to Xn and Y1 to Yn of the PDP 10, respectively. When the resulting potential difference (|Vx|+|Vy|) between the row electrodes X1 to Xn and Y1 to Yn (where |Vx|<Vrx and |Vy|<Vry) is above a discharge initiating voltage Vx-y between the row electrodes, a discharge is produced between the row electrodes at all the discharge cells of the PDP 10, thereby causing a predetermined amount of uniform wall charges to build up in each discharge cell. This allows all the discharge cells of the PDP 10 to be in the emission mode which enables light to be emitted in the sustain emission step, discussed later.

In the pixel data write step Wc, the address driver 6 applies sequentially each row of pixel data pulse groups $DP1_1$ to $DP1_n$, $DP2_1$ to $DP2_n$, $DP3_1$ to $DP3_n$, . . . , $DP14_1$ to $DP14_n$ to the column electrodes D1 to Dm, respectively. For example, in the sub-field SF1, the address driver 6 applies sequentially the pixel data pulses $DP1_1$ to $DP1_n$, which correspond to the first to the nth rows respectively and which have been generated in accordance with the first bit of the converted pixel data $HD_{1,1}$ to $HD_{m,n}$, to each display line of the column electrodes D1 to Dm. Then, in the sub-field SF2, the address driver 6 applies sequentially the pixel data pulses $DP2_1$ to $DP2_n$, which have been generated in accordance with the second bit of the aforementioned converted pixel data $HD_{1,1}$ to $HD_{m,n}$, to each display line of the column electrodes D1 to Dm. At this time, for example, only when the bit logic of the converted pixel data has logic level "1", the address driver 6 generates a high-voltage pixel data pulse to be applied to the column electrode D. The second sustain driver 8 generates the scan pulse SP at the same timing as the application timing of each pixel data pulse group DP to apply the resulting scan pulse SP sequentially to the row electrodes Y1 to Yn. At this time, only the discharge cell at a Y-row electrode having the scan pulse SP applied thereto and a column electrode having the high-voltage pixel data pulse applied thereto produces a discharge (a selective erase discharge) between the Y-row electrode and the column electrode, thereby erasing the wall charge remaining in the discharge cell. This selective erase discharge causes the discharge cell that has been set in the emission state in the simultaneous reset step Rc to transfer to the non-emission state. A discharge cell associated with a column electrode to which no high-voltage pixel data pulse has been applied produces no discharge, and is sustained in the state that has been set in the simultaneous reset step Rc, i.e., in the emission state.

That is, depending on the pixel data, the pixel data write step Wc selectively places the discharge cells in the emission state or mode that is sustained in the subsequent sustain emission step and in the non-emission state or mode. This means that the so-called pixel data write operation is performed on the discharge cells.

The scan pulse SP is generated in each of the sub-fields SF1 to SF14 in the order of the row electrodes Y1 to Yn.

In the emission sustain step Ic, the first and second sustain drivers 7, 8 alternately apply the sustain pulses IPx, IPy of a pulse amplitude value Vs to the row electrodes X1 to Xn and Y1 to Yn. At this time, during the alternate application of the sustain pulses IPx, IPy, the discharge cell having a wall charge allowed to remain in the pixel data write step Wc, i.e., the discharge cell in the emission mode produces a discharge repeatedly between the row electrodes of the row electrode pair to sustain the emission state. The duration of emission in the emission sustain step Ic differs between each of the sub-fields.

That is, suppose that the duration of emission in the emission sustain step Ic of the sub-field SF1 is "1". In this case, the durations of emission in the other sub-fields are set such that with SF1 being set at 1, SF2 is set at 3, SF3 at 5, SF4 at 8, SF5 at 10, SF6 at 13, SF7 at 16, SF8 at 19, SF9 at 22, SF10 at 25, SF11 at 28, SF12 at 32, SF13 at 35, and SF14 at 39.

In this manner, the ratio of the number of times of emission between each of the sub-fields SF1 to SF14 is set to be nonlinear (e.g., the inverse gamma ratio $Y=X^{2.2}$), thereby correcting the nonlinear characteristics of the input pixel data D.

In the erase step E of the last sub-field SF14 in one field, the address driver 6 generates an erase pulse AP to be applied to the column electrodes D1 to Dm. On the other hand, the second sustain driver 8 generates the erase pulse EP at the same time as the application timing of the erase pulse AP to apply the erase pulse EP to each of the row electrodes Y1 to Yn. The simultaneous application of the erase pulses AP and EP produces an erase discharge in all the discharge cells of the PDP 10, thereby causing the wall charges remaining in all the discharge cells to vanish. That is, the erase discharge places all the discharge cells of the PDP 10 in the non-emission mode.

FIG. 7 illustrates all the emission drive patterns implemented in accordance with the emission drive format shown in FIGS. 4 and 6.

As shown in FIG. 7, only in the pixel data write step Wc of one of the sub-fields SF1 to SF14, a selective erase discharge is produced in each discharge cell (shown by black circles). That is, the wall charges deposited in all the discharge cells of the PDP 10 in the simultaneous reset step Rc remain until the aforementioned selective erase discharge is initiated, and cause emission by discharge in the emission sustain step Ic of each sub-field that is present until the selective erase discharge is initiated (shown by hollow circles). That is, each discharge cell stays in the emission mode until the selective erase discharge is initiated in one field period, and continues emitting light at the emission duration ratio shown in FIG. 4 in the emission sustain step Ic of each of the sub-fields that are present until then.

At this time, the number of times of transition in a discharge cell from the emission mode to the non-emission mode is so set as to be always one in one field period. That is, in one field period, such an emission drive pattern is prohibited which allows a discharge cell having been placed in the non-emission mode to restore the emission mode.

Accordingly, the simultaneous reset operation that involves a light emission of high intensity without contributing to image display may be performed only once in one field period, thereby making it possible to prevent reduction in contrast.

It is also possible to reduce power consumption in the PDP because the selective erase discharge is produced once at most in one field period. Additionally, pseudo-contours on the screen of the PDP can be prevented.

Figure 8:
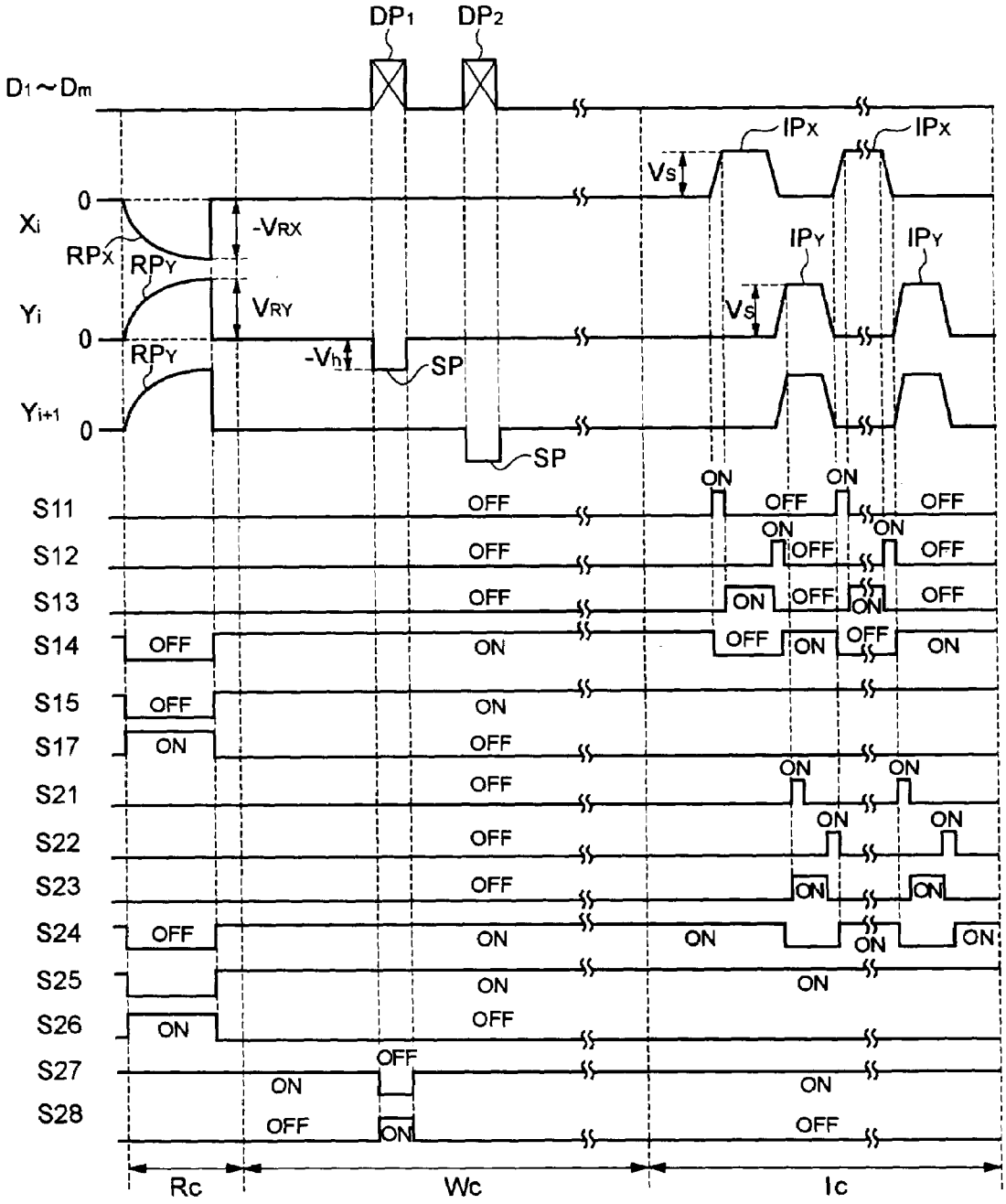
FIG. 8 is a view illustrating the application timing of a drive pulse to column and row electrodes and the ON/OFF timing of each switch element.

FIG. 8 shows the various drive pulses to be applied to the PDP 10 by the address driver 6 and the first and second sustain drivers 7, 8 and the ON/OFF timing of the switch elements in the drivers 7, 8 in the case where the selective erase addressing method is employed in the sub-field SF1 of FIG. 4.

In the simultaneous reset step Rc, the drive controller 2 supplies a switching signal SW17 to the reset pulse generator RX only during a predetermined period of time. The signal being supplied turns on the switch element S17, thereby allowing the voltage $V_{RX}$ to be applied from the negative output terminal of the DC power supply B12 to the row electrode Xi via the resistor R11. At this time, the load capacitance C0 present between the row electrodes Xi and Yi causes the potential of the row electrode Xi to be gradually reduced to the voltage $-V_{RX}$.

Through the aforementioned operation, the first sustain driver 7 applies, to the row electrodes X1 to Xn, the negative reset pulse RPx which has the waveform shown in FIG. 8, i.e., which has a negative polarity and a gradually reduced voltage.

Additionally, in the simultaneous reset step Rc, the drive controller 2 generates switching signals SW27, SW26 only during a predetermined period of time at the same timing as that of the switching signal SW17. The switching signal SW27 is supplied to the scan pulse generator SY, while the switching signal SW26 is supplied to the reset pulse generator RY. The switch element S27 is turned on in response to the switching signal SW27, allowing the potential on the connection line 20 to be applied as it is to the row electrode Yi. The switch element S26 is turned on in response to the switching signal SW26, allowing the voltage $V_{RY}$ or a voltage at the positive terminal of the DC power supply B14 to be applied to the row electrode Yi via the switch element S26, the resistor R21, and the line 20. At this time, the load capacitance C0 between the row electrodes Xi, Yi causes the potential of the row electrode Yi to gradually increase to the voltage $V_{RY}$.

Through the aforementioned operation, the second sustain driver 8 simultaneously applies the positive reset pulse RPy having the waveform shown in FIG. 8 to each of the row electrodes Y1 to Yn at the same time as the application of the reset pulse RPx. That is, the second sustain driver 8 applies the reset pulse RPy, the voltage of which gradually increases to the voltage $V_{RY}$, to the row electrodes Y1 to Yn.

The application of the reset pulses RPx, RPy results in a weak discharge to produce priming particles in all the discharge cells of the PDP 10 when the potential difference between the row electrode pairs (X1, Y1) to (Xn, Yn) is above the minimum reset discharge initiating voltage $V_{MIN}$. Then, successive applications of the potential difference greater than the reset discharge initiating voltage $V_{MIN}$ during a predetermined period of time allow a predetermined amount of wall charges to build up in the discharge cells. That is, the application of the minimum voltage $V_{MIN}$, which is capable of creating a reset discharge, to the discharge cells causes a discharge to be produced at low emission intensity, while the successive application of the voltage between the row electrodes allows the predetermined amount of wall charges to be deposited in a short period of time.

The execution of the simultaneous reset step Rc causes all the discharge cells of the PDP 10 to be initialized to the emission mode which enables emission (sustain discharge) to be produced in the subsequent emission sustain step Ic.

In the case of the selective write addressing method being employed, the simultaneous reset step Rc applies simultaneously the erase pulse EP, or a short pulse which is opposite in polarity to the reset pulse RPx, to all the row electrodes X1 to Xn to create a discharge. The creation of discharge causes the wall charges of all the discharge cells to vanish, thus resetting all the discharge cells to the non-emission mode. Furthermore, the scan, pulse SP of negative polarity applied in the pixel data write step Wc causes a discharge (selective write discharge) to occur only at the discharge cell located at the point of intersection of the display line to which the scan pulse SP has been applied and the column to which a high-voltage pixel data pulse has been applied. This selective write discharge induces wall charges in the discharge cell, which is then set to the emission mode that enables emission (a sustain discharge) to occur in the subsequent emission sustain step Ic. On the other hand, the aforementioned selective write discharge is not created in a discharge cell to which the scan pulse SP has been applied but a low-voltage pixel data pulse has been applied, the discharge cell being set to the non-emission mode while being sustained in the initialized state provided in the previous simultaneous reset step Rc, i.e., in the state of having no wall charges.

Then, in the pixel data write step Wc, the address driver 6 generates a pixel data pulse having a pulse voltage corresponding to a pixel drive data bit DB supplied by the memory 4. In the sub-field SF1, the address driver 6 generates a high-voltage pixel data pulse when the logic level of the pixel drive data bit is "1", whereas generating a low-voltage (0-volt) pixel data pulse when the level is "0". Then, the address driver 6 applies sequentially the pixel data pulse groups DP1 to DPn, each group having each display line of pixel data pulses, to the column electrodes D1 to Dm.

Meanwhile, the drive controller 2 successively supplies a switching signal SW28 to the scan pulse generator SY for the corresponding row electrode in sync with the application timing of each of the pixel data pulse groups DP1 to DPn. At this time, in the scan pulse generator SY to which the switching signal SW28 has been supplied, the switch element S28 is turned on, with the switch element S27 being turned off. As shown in FIG. 8, this allows the negative voltage −Vh to be applied by the power supply B15 to the row electrode Yi via the switch element S28 and the connection line 40. A negative scan pulse SP having a voltage of −Vh is applied to the row electrode Yi or the aforementioned corresponding row electrode. This causes a discharge (selective erase discharge) to occur only in the discharge cell located at the point of intersection of the display line to which the scan pulse SP has been applied and the column electrode to which a high-voltage pixel data pulse has been applied. This selective erase discharge causes the wall charges stored in the discharge cell to vanish, allowing the discharge cell to transfer to the non-emission mode that allows no emission (sustain discharge) in the emission sustain step Ic, discussed later. On the other hand, no selective erase discharge is created in the discharge cell to which the scan pulse SP has been applied but a low-voltage pixel data pulse has been applied, allowing the discharge cell to be held in the state initialized in the simultaneous reset step Rc, i.e., in the emission mode.

In the case of the selective write addressing method being employed, a negative scan pulse SP applied in the pixel data write step Wc allows a discharge (selective write discharge) to occur only in the discharge cell located at the point of intersection of the display line to which the scan pulse SP has been applied and the column to which a high-voltage pixel data pulse has been applied. This selective write discharge induces wall charges in the discharge cell, which is set to the emission mode that enables emission (a sustain discharge) to occur in the subsequent emission sustain step Ic. On the other hand, no selective write discharge is created in a discharge cell to which the scan pulse SP has been applied but a low-voltage pixel data pulse has been applied, the discharge cell being set to the non-emission mode while being sustained in the initialized state provided in the previous simultaneous reset step Rc, i.e., in the state of having no wall charges.

That is, in either the selective erase addressing method or the selective write addressing method, the pixel data write step Wc causes each discharge cell of the PDP 10 to be set to either the emission mode or the non-emission mode depending on the pixel data based on an input video signal.

Then, in the emission sustain step Ic, the drive controller 2 supplies switching signals SW11 to SW15 to the sustain pulse generator IX. First, in response to the switching signals SW11 to SW15, each of the switch elements S11 and S15 is turned on, allowing a current originated from the charges stored in the capacitor C11 to flow into a discharge cell via the coil L11, the diode D11, the switch elements S1, S15, the connection line 30, and the row electrode Xi. This causes the voltage of the row electrode Xi to gradually increase. Then, the switch elements S13, S15 are turned on, allowing the output voltage Vs from the DC power supply B11 to be applied to the row electrode Xi via the switch elements S13, S15 and the connection line 30. This causes the voltage of the row electrode Xi to be the voltage Vs. Then, the switch elements S12, S15 are turned on, allowing a current originated from the charges stored in the load capacitance C0 between the row electrodes Xi and Yi to flow from the row electrode Xi into the capacitor C11 via the connection line 30, the switch element S15, the coil L12, the diode D12, and the switch element S12. This causes the voltage of the row electrode Xi to decrease. Repetition of the aforementioned operations allows the sustain pulse generator IX to repeatedly apply the sustain pulse IPx to the row electrodes X1 to Xn.

Furthermore, in the emission sustain step Ic, the drive controller 2 supplies switching signals SW21 to SW25 to the sustain pulse generator IY. First, in response to the switching signals SW21 to SW25, the switch elements S21 and S25 are turned on. During the period of the emission sustain step Ic, the switch element S27 is kept in the ON state, whereas the switch element S28 is kept in the OFF state. Accordingly, the current originated from the charges stored in the capacitor C21 flows into a discharge cell via the coil L21, the diode D21, the switch elements S21, S25, the connection line 20, the switch element S27, the connection line 40, and the row electrode Yi. This causes the voltage of the row electrode Yi to increase. Then, the switch elements S23, S25 are turned on, allowing the voltage Vs from the DC power supply B13 to be applied to the row electrode Yi via the switch elements S23, S25, the connection line 20, the switch element S27, and the connection line 40. This causes the voltage of the row electrode Yi to be the voltage Vs. Then, the switch elements S22, S25 are turned on, allowing a current originated from the charges stored in the load capacitance C0 between the row electrodes Xi and Yi to flow into the capacitor C21 via the row electrode Yi, the connection line 40, the switch element S27, the connection line 20, the switch element S25, the coil L22, the diode D22, and the switch element S22. This causes the voltage of the row electrode Yi to decrease. Repetition of the aforementioned operations allows the sustain pulse generator IY to repeatedly apply the sustain pulse IPy to the row electrodes Y1 to Yn.

As described above, in the emission sustain step Ic, the first and second sustain drivers 7, 8 alternately apply the positive sustain pulses IPx and IPy to the row electrodes X1 to Xn and Y1 to Yn, respectively. At this time, only such a discharge cell as having wall charges, i.e., only a discharge cell in the emission mode produces a discharge (sustain discharge) repeatedly each time the sustain pulses IPx and IPy are applied thereto, thus repeatedly providing light emission resulting from the discharge.

As described above, only such discharge cells in which the wall charges deposited by the reset discharge in the simultaneous reset step Rc remain unerased in the pixel data write step Wc emit light repeatedly in the emission sustain step Ic to form a display image.

In the erase step after the sustain emission step, the positive erase pulse AP is applied to the column electrodes D1 to Dm, while the negative erase pulse EP is applied at the same time to the row electrodes Y1 to Yn. In the discharge cells in the non-emission mode, this causes a small amount of positive wall charges to remain in the row electrodes Y as well as a small amount of negative wall charges to remain in the row electrodes X and the column electrodes, thereby creating a condition in which a discharge can be readily produced between the column electrodes and the row electrodes.

Thereafter, in the simultaneous reset step Rc in the subsequent field, the aforementioned operations are repeated in the order of the pixel data write step Wc, the emission sustain step Ic, and the erase step.

In the emission sustain step Ic, the sustain pulse applied causes a predetermined amount of wall charges to be deposited. Thus, in the discharge cells in the emission mode, a voltage greater than or equal to the discharge initiating voltage is applied for a discharge current to flow, thereby causing emission. However, since part of the path through which the discharge current flows is integrated into modules as the switch modules SWX and SWY as described above, the length and width of the patterned traces can be optimized. For example, the length of the trace can be shortened, and the width of the trace can be increased. Since this allows for reducing the inductance component of the patterned trace, the waveform of the drive pulse can be provided with reduced ripples and the voltage of the drive pulse can be increased. As a result, brightness and emission efficiency can be improved.

Figure 9A:
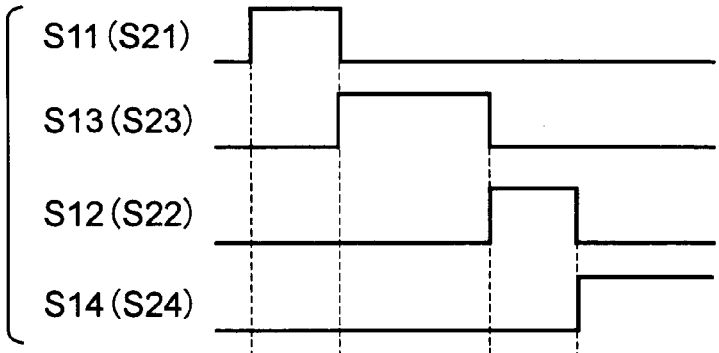
FIGS. 9A to 9D are explanatory views illustrating a sustain pulse being reduced in ripple.
Figure 9B:
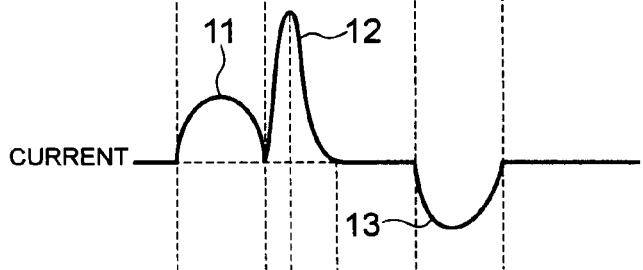
Figure 9C:
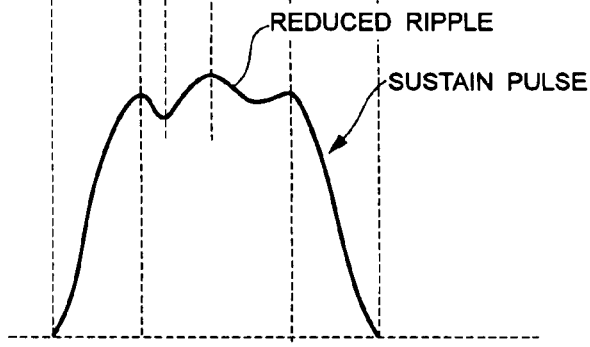
Figure 9D:
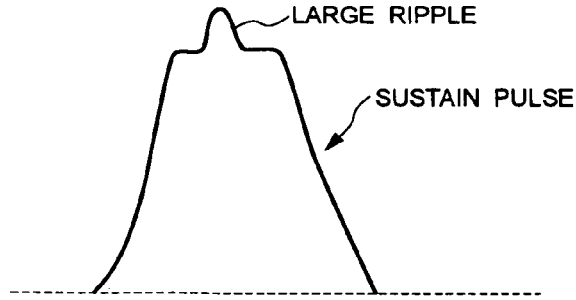

FIGS. 9A to 9D show the flow of a recharge current I1 and discharge currents I2, I3 and the reduction of ripples in the sustain pulse of the drive pulses, provided by the switch elements S11, S14 being turned ON or OFF. That is, as shown in FIGS. 9A and 9B, the recharge current I1 flows during the ON period of the switch element S11 to recharge the load capacitance C0, the discharge current I2 flows into a discharge cell placed in the emission mode during the ON period of the switch element S13, and the discharge current I3 flows from the load capacitance C0 during the ON period of the switch element S12. Since the aforementioned modules contribute to reduction in inductance component of the patterned trace, the turn-on characteristics of these currents are improved. As shown in FIG. 9C, the waveform of the sustain pulse is provided with reduced ripples when compared with the conventional sustain pulse shown in FIG. 9D.

The voltages $V_{RX}$, $V_{RY}$ of the reset pulses RPx, RPy are greater than the voltage Vs of the sustain pulses. Upon generation of the reset pulses, this causes a voltage greater than the output voltage Vs from the DC power supplies B11, B13 to be applied to the switch element in the resonance circuit. Accordingly, without the masking circuit (the switch elements S15, S25), a high-breakdown switch element is required. The switch elements S15, S25 constituting the masking circuit are turned off during the generation of the reset pulses RPx, RPy, allowing the potential difference between the output voltages $V_{RX}$, $V_{RY}$ from the DC power supplies B12, B14 in the reset pulse generators RX, RY and the output voltage Vs from the DC power supplies B11, B13 in the resonance circuit to eliminate the need of employing a high-breakdown switch element as the switch element in the resonance circuit.

The aforementioned embodiment is adapted such that the positive sustain pulses IPx, IPy, the negative reset pulse RPx, and the positive reset pulse RPy are generated, allowing each voltage of the reset pulses is greater than the voltage Vs of the sustain pulses; however, the polarities of the sustain pulses and the reset pulses are not limited thereto.

As described above, the present invention integrates the clamping circuit and the masking circuit into a module to improve the waveforms of the drive pulses, thereby providing increased brightness and emission efficiency.

This application is based on a Japanese Application No. 2003-59613 which is hereby incorporated by reference.

What is claimed is:

1. A drive apparatus for applying a first drive pulse and a second drive pulse to row electrodes to drive a display panel having the row electrodes, column electrodes arranged to intersect the row electrodes, and capacitive light-emitting elements disposed at intersection portions of the row electrodes and the column electrodes, said apparatus comprising:

a first drive pulse generation portion having a resonance circuit which selectively forms a forward/reverse current path including inductance, and a clamping circuit which includes a first switch for selectively clamping an output terminal potential of the resonance circuit at a power supply potential and a second switch which selectively clamps the output terminal potential of the resonance circuit at a ground potential, so that said first drive pulse generation portion generates the first drive pulse to be applied to an output line;

a second drive pulse generation portion which generates the second drive pulse to be applied to the row electrodes; and a masking circuit which is turned on to connect between the output line and the row electrodes when the first drive pulse generation portion applies the first drive pulse to the row electrodes, and which is turned off to disconnect between the output line and the row electrodes when the second drive pulse generation portion applies the second drive pulse to the row electrodes, wherein the clamping circuit and the masking circuit are formed in a module.

2. The drive apparatus according to claim 1, wherein the second drive pulse is different in polarity from the first drive pulse.

3. The drive apparatus according to claim 1, wherein the second drive pulse is greater in voltage than the first drive pulse.

4. The drive apparatus according to claim 1, wherein the first drive pulse is a sustain pulse and the second drive pulse is a reset pulse.

* * * * *